United States Patent [19]

DeZurik

[11] 4,325,229

[45] Apr. 20, 1982

[54] INTERIOR AIR CONDITIONER COVER

[76] Inventor: Ted E. DeZurik, 2141 East Kenwood Dr., St. Paul, Minn. 55117

[21] Appl. No.: 138,175

[22] Filed: Apr. 7, 1980

[51] Int. Cl.[3] ..... F25D 23/12; B65B 11/00

[52] U.S. Cl. ..... 62/262; 62/265; 98/114; 150/52 R

[58] Field of Search ..... 150/52 R; 62/262, 265; 98/94 AC, 114; 49/465

[56] References Cited

U.S. PATENT DOCUMENTS

| | | | |
|---|---|---|---|
| 2,714,546 | 8/1955 | Lesniak | 49/465 |
| 2,826,472 | 3/1958 | Humphner | 312/101 |
| 2,850,774 | 9/1958 | Carnick | 49/465 |
| 2,992,668 | 7/1971 | Collard | 150/52 |
| 3,002,236 | 10/1961 | Humphner | 20/40 |
| 4,103,701 | 8/1978 | Jeng | 150/52 R |
| 4,220,368 | 9/1980 | Ferrigan | 49/465 X |

*Primary Examiner*—William E. Wayner

*Attorney, Agent, or Firm*—Kinney, Lange, Braddock, Westman and Fairbairn

[57] ABSTRACT

The present invention relates to a weather tight cover which overlies the portion of a through-the-wall air conditioner that protrudes into a room. The cover has a peripheral sealing gasket to tightly fit against the molding or wall surfaces surrounding the opening for the air conditioner to thereby tightly seal the entire unit to provide for a draft free, insulated cover that conserves energy by substantially reducing heat losses through the interior air conditioner openings and through gaps between the outer air conditioner housing and the edges of the opening through the wall.

4 Claims, 5 Drawing Figures

INTERIOR AIR CONDITIONER COVER

BACKGROUND OF THE INVENTION

1. Field of the Invention

The present invention relates to covers for sealing the openings around a through-the-wall air conditioner.

2. Prior Art

In the prior art, various types of covers have been made for air conditioners. It is well known to utilize an exterior plastic type sheet or cover that fits over the housing of a window or through-the-wall air conditioner. However, these generally are not tight, and permit air leaks around the periphery of the air conditioner housing. The exterior covers usually seal only the ventilation openings in the air conditioner itself.

A storm window that includes portions that fit over the air conditioner and which are made out of molded plastic is shown in U.S. Pat. No. 3,002,236. While the unit as shown therein is primarily for exterior mounting, it is disclosed as being mountable on the interior of a house. However, the unit does not provide a tight seal around a wall-mounted air conditioner to prevent drafts by including a weather strip forced tightly against a perimeter surface around the air conditioner housing with fastener members.

U.S. Pat. No. 2,992,668 provides a cover for an air conditioner that seals against the housing or can of the air conditioner. While this patent does suggest closing off drafts and air exchange through the air conditioner it does not show a tight peripheral seal to completely seal off drafts between the housing and the edges of the wall opening for the air conditioner.

U.S. Pat. No. 2,826,472 shows a multi-section box which can be used around an air conditioner on the exterior of the house.

U.S. Pat. No. 4,103,701 shows a type of housing used over an outdoor faucet to aid in preventing the faucet from freezing.

SUMMARY OF THE INVENTION

The present invention relates to the interior cover for the portion of the housing of a through-the-wall air conditioner which protrudes into the room. The cover fits over the portion of the air conditioner on the inside of the room wall and seals tightly all around the peripheral edges against either a molding surrounding the opening in the wall or directly on portions of the wall at locations spaced outward slightly from the edges of the wall opening made for the air conditioner. Fasteners are provided to draw the cover downwardly toward the wall to compress the gasket and thereby tightly seal the wall opening to avoid drafts and loss of heat from the interior of the room.

By sealing against the molding or directly against the wall surface, the openings through the air conditioner itself are also closed. That is, the ventilation openings and cool air passageways in the air conditioner, and also the cracks that are present between the air conditioner housing and the opening cut in the wall are sealed tightly.

The unit preferably can be molded in one piece and fasteners which draw the relatively thick gasket down tightly are used to insure a tight seal.

DESCRIPTION OF THE PREFERRED EMBODIMENT

Figure 1:
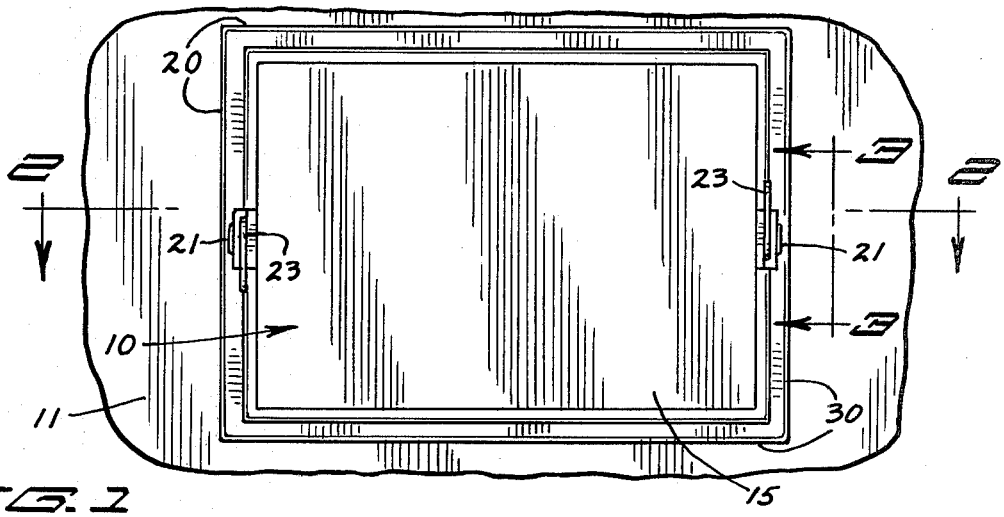
FIG. 1 is an elevational view from the inside of a building showing a cover made according to the present invention installed over the interior poritons of a through-the-wall air conditioner.
Figure 2:
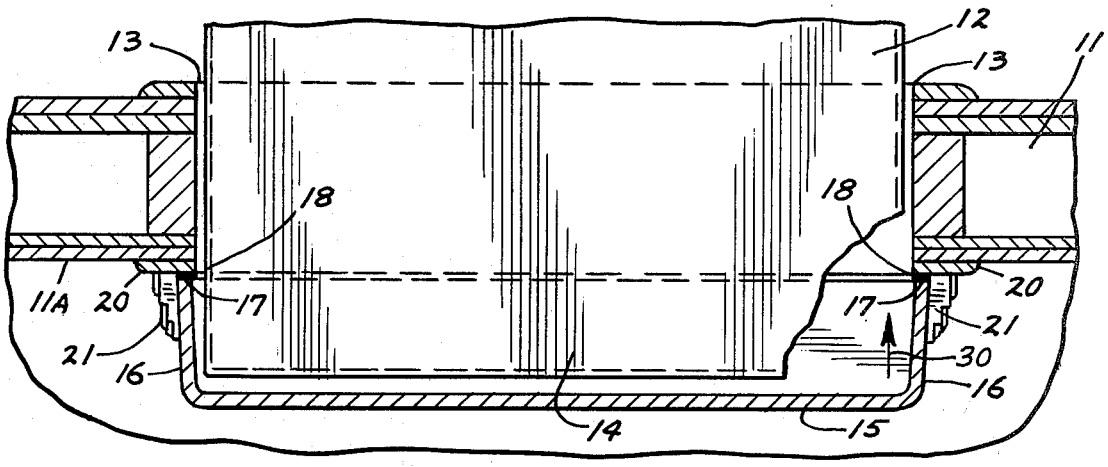
FIG. 2 is a sectional view taken as on line 2—2 in FIG. 1.
Figure 3:
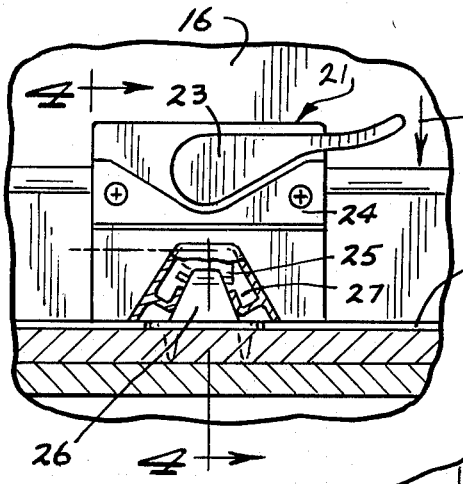
FIG. 3 is a fragmentary enlarged sectional view taken as on line 3—3 in FIG. 1.
Figure 4:
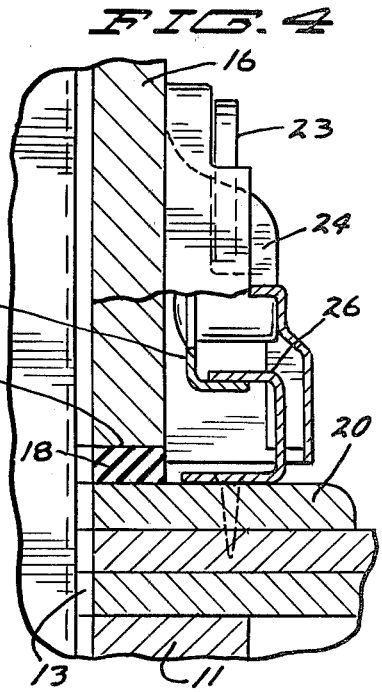
FIG. 4 is a sectional view taken as on line 4—4 in FIG. 3.

Referring to FIG. 1, an air conditioner cover indicated generally at 10 made according to the present invention is mounted relative to the interior surface of a building wall 11. The air conditioner can or housing indicated generally at 12 as shown fits within an opening 13 defined through the wall, and generally such air conditioners protrude inwardly past the interior wall surface. This protruding portion (indicated generally at 14) of the air conditioner housing usually provides a louver through which the cool air will be discharged into the room, as well as a room air intake and access for controls and filters that are provided when the air is circulated from the room through the air conditioner. Air conditioners also have ducts open to the exterior for fresh air intake and cooling of the condensor.

The interior air conditioner passage of the housing are never adequately sealed when the air conditioner is not in user, and thus a substantial inflow of air can occur from the exterior through the air conditioner housing into the interior of the room. Additionally, the gaps between the edges of the wall opening and the air conditioner housing are also difficult to seal tightly even with caulking or other sealants. Thus, the cover 10 is provided for insuring that an air tight seal is made aroung the periphery of opening 13, which completely closes off the interior passageways through the air conditioner housing 12, as well as closing off any air leakage through the gaps between the edges of the opening 13 and the housing.

Cover 10 as shown has a planar end wall 15 which is slightly larger than the opening 13, and the wall 15 has perimeter walls 16 fixed thereto and the walls 16 have outer edge portions 17. The wall edge portions 17 have outer end edge surfaces on which a peripheral resilient gasket 18, of substantial depth, is placed. The gasket is foam and has the ability to compress substantially. Gasket 18 extends outwardly from the edge 17 and seats against either the interior wall surface 11, or peripheral casing 20 that forms a portion of the interior wall surface and surrounds the opening 13 for the air conditioner housing.

The gasket 18 is compressible to a substantial degree, and the walls 16 are sufficiently rigid so that they will not give or buckle when load is placed on the walls. Fasteners indicated generally at 21 are mounted at opposite ends of the housing 10, on the opposite walls 16 at the sides of the housing. The fasteners as shown are over-center lock type fasteners that are commonly used for casement windows. The fasteners have an over-center lever control 23 mounted in a housing 24 that is attached to the side walls 16 of the housing 10. The lever controls a latch finger 25 that goes under a latch plate or member 26 which in turn is fixed to the casing or molding 20, or to the wall 11 itself.

The housing 24 includes guide members 27 that are tapered to fit the tapered edges of the latch plate. The finger 25 first moves to fit under the lip of the latch plate 26 and upon further operation of the lever 23 the finger 25 moves in direction to draw the parts together, and at the same time, therefore, pull the edges 17 toward the wall 11.

Again, it is to be understood that the latches or fasteners 21 are conventional units used on casement windows and provide a component of force in the direction as indicated by the arrow 30 on the housing to tend to compress the gasket 18 all the way around the periphery of the unit to seal any cracks or openings and thereby provide for a draft free housing surrounding the air conditioner and the opening 13. The interior of the cover 10 is thus isolated from the room.

Figure 5:
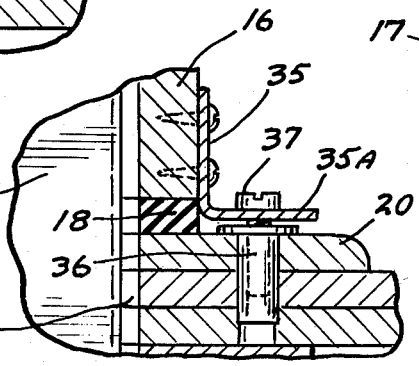
FIG. 5 is a sectional view of a modified form of the fastener for holding the air conditioner cover made according to the present invention in place.

A modified form of a latch member is shown in FIG. 5. The wall 16 of the housing has an angle bracket 35 mounted thereon, and the bracket leg 35A extends parallel to the casing or molding 20. Suitable screw anchors 36 are provided in the casing 20 and in the outer portions of the wall 11. A screw 37 extends through a provided opening in the leg 35 and is threaded into the anchor 36. The edges 17 of walls 16 can be clamped against the casing 20 by threading the screw 37 into the anchor to force the wall 16, and the housing 10 toward the wall 11. This movement compresses the gasket 18 and provides a tight seal around the opening 13.

The cover 10 can be molded from suitable durable plastic such as polycarbonate, and if desired can be a rigid foam (insulating) material to provide insulation as well as rigidity and decorative appearance.

The walls 16 are tapered from the wall 15 outwardly toward the edges 17 in order to provide draft for molding purposes. The latches or securing members can be added subsequent to the molding operation, and the device can easily be installed with suitable fasteners to provide for a distinct motion for compressing gasket 18 against the interior wall surface, comprising a molding or other wall surface for completely sealing around the periphery of the opening for the through-the-wall air conditioner.

The cover 10 mounts entirely from the interior of the building and thus there is no need to go outside to install or remove the cover. No ladder or scaffolding are necessary. The interior cover closes all drafts off and can be finished to blend in with the room decor.

The interior surfaces of the walls of the cover may be covered with insulation material if desired to reduce heat transfer, as well as making the walls of a material which has low thermal conductivity, such as a foamed plastic material.

What is claimed is:

1. In combination with a through-the-wall air conditioner having a housing, said housing being mounted in an opening defined in a building wall, the improvement comprising a cover which overlies a portion of the air conditioner protruding through said wall to the interior of a room, said cover including a peripheral wall of slightly larger size than the opening, said peripheral wall having outer edges that lie generally along a plane corresponding to the plane of the wall through which the opening is defined, gasket means on the outer edges of said peripheral wall of said cover, said gasket means being compressible a substantial amount, and cooperating latch means on the cover and the interior of the room to latch said cover in position with the outer edges of said peripheral wall of said housing circumscribing the opening through the building wall, said latch means including means to provide a force urging the outer edges of the peripheral wall toward the building wall to compress said gasket to seal around the opening.

2. The combination of claim 1 and an integrally molded end wall connected to the peripheral walls to form a unitary closed molded cover.

3. The combination of claim 2 wherein the cover is molded of a foamed plastic material to minimize heat transfer through the cover.

4. The combination of claim 2 wherein said peripheral walls include top and bottom walls and side walls joining said top and bottom walls, said latch means including first portions on each of the side walls engageable with second portions mounted on the building wall, said side walls being rigid to transfer compressive forces from the latch means acting on the resilient gasket to be transferred through the peripheral walls around the entire periphery of the cover.

* * * * *